US010093031B2

(12) United States Patent
Ren

(10) Patent No.: US 10,093,031 B2
(45) Date of Patent: Oct. 9, 2018

(54) RAZOR HEAD HAVING A TRIMMING UNIT

(71) Applicant: Xiangrong Ren, Wenzhou (CN)

(72) Inventor: Xiangrong Ren, Wenzhou (CN)

( * ) Notice: Subject to any disclaimer, the term of this patent is extended or adjusted under 35 U.S.C. 154(b) by 0 days.

(21) Appl. No.: 15/244,619

(22) Filed: Aug. 23, 2016

(65) Prior Publication Data

US 2017/0173805 A1 Jun. 22, 2017

(30) Foreign Application Priority Data

Dec. 22, 2015 (CN) ..... 2015 1 0975675

(51) Int. Cl.
*B26B 21/40* (2006.01)
*B26B 21/34* (2006.01)
*B26B 21/44* (2006.01)

(52) U.S. Cl.
CPC ..... *B26B 21/4025* (2013.01); *B26B 21/34* (2013.01); *B26B 21/4018* (2013.01); *B26B 21/4043* (2013.01); *B26B 21/443* (2013.01)

(58) Field of Classification Search
CPC ..... B26B 21/14; B26B 21/16; B26B 21/22; B26B 21/222; B26B 21/225; B26B 21/34; B26B 21/40; B26B 21/4012; B26B 21/4018; B26B 21/4025; B26B 21/4043
USPC ..... 30/34.1, 47–51, 84
See application file for complete search history.

(56) References Cited

U.S. PATENT DOCUMENTS 3,213,745 A * 10/1965 Dwyer ..... F16B 13/06 174/153 G
4,112,815 A * 9/1978 Tanaka ..... F16B 21/086 248/73
4,378,633 A * 4/1983 Jacobson ..... B26B 21/227 30/47
4,378,634 A * 4/1983 Jacobson ..... B26B 21/227 30/47
4,492,024 A * 1/1985 Jacobson ..... B26B 21/225 30/50
4,502,217 A * 3/1985 Schachter ..... B26B 21/4018 30/82
4,586,255 A * 5/1986 Jacobson ..... B26B 21/4018 30/50

(Continued)

FOREIGN PATENT DOCUMENTS

EP 3184266 A1 * 6/2017 ..... B26B 21/4043
EP 3254814 A1 * 12/2017

(Continued)

*Primary Examiner* — Jason Daniel Prone
(74) *Attorney, Agent, or Firm* — Shimokaji IP

(57) ABSTRACT

A razor head having trimming unit includes a framework, at least one razor blade, a trimming unit, and a lubricating strip. The framework includes a front part, a rear part and two side parts. The trimming unit is arranged along a lengthwise direction of the framework and configured on the two side parts. The trimming unit and the rear part are configured side by side and define a receiving groove together. A side wall of the rear part for defining the receiving groove has a first contact portion extended into the receiving groove, and a side wall of the trimming unit for defining the receiving groove has a second contact portion extended into the receiving groove. The second contact portion corresponds to the first contact portion so that the first and the second contact portions clamp the lubricating strip in the receiving groove together.

10 Claims, 11 Drawing Sheets

(56) References Cited

U.S. PATENT DOCUMENTS 4,800,629 A * 1/1989 Ikeda ..... A44B 11/005 24/170
4,841,100 A * 6/1989 Ignasiak ..... H05K 3/301 174/138 G
4,866,844 A * 9/1989 Burout, III ..... B26B 21/22 30/50
5,036,587 A * 8/1991 Trotta ..... B26B 21/44 30/84
5,067,238 A * 11/1991 Miller ..... B26B 21/227 30/50
5,176,349 A * 1/1993 Bendorf ..... F16B 21/088 248/220.22
5,274,887 A * 1/1994 Fudaki ..... A44B 11/28 24/265 H
5,661,907 A * 9/1997 Apprille, Jr. ..... B26B 21/225 30/47
5,678,311 A * 10/1997 Avidor ..... B26B 19/30 30/50
5,761,814 A * 6/1998 Anderson ..... B26B 21/227 30/50
5,933,960 A * 8/1999 Avidor ..... B26B 19/30 30/50
6,009,624 A * 1/2000 Apprille, Jr. ..... B26B 21/227 30/48
6,035,537 A * 3/2000 Apprille, Jr. ..... B26B 21/227 30/346.5
6,276,061 B1 * 8/2001 Rozenkranc ..... B26B 21/22 30/34.1
7,581,318 B2 * 9/2009 Coffin ..... B26B 21/443 30/50
7,761,999 B2 * 7/2010 Macove ..... B26B 21/22 30/34.1
8,261,451 B2 * 9/2012 Macove ..... B26B 21/22 30/34.1
8,567,068 B2 * 10/2013 Luxton ..... B26B 21/225 30/34.1
8,689,448 B2 * 4/2014 Ren ..... B26B 21/4012 30/34.1
8,782,903 B2 * 7/2014 Clarke ..... B26B 21/4018 30/34.1
9,193,080 B2 * 11/2015 Whelan ..... B26B 21/227
9,254,908 B2 * 2/2016 Healy ..... B64C 1/406
D776,875 S * 1/2017 Ren ..... D28/47
2004/0055156 A1 * 3/2004 Brown, Jr. ..... B26B 21/16 30/34.1
2004/0181954 A1 * 9/2004 Folio ..... B26B 21/222 30/527
2005/0022386 A1 * 2/2005 Macove ..... B26B 21/22 30/50
2005/0039337 A1 * 2/2005 Pennell ..... B26B 21/222 30/346.5
2005/0198829 A1 * 9/2005 Gray ..... B26B 21/222 30/50
2005/0198841 A1 * 9/2005 Worrick, III ..... B26B 21/222 30/527
2005/0198842 A1 * 9/2005 Walker ..... B26B 21/225 30/527
2005/0235495 A1 * 10/2005 Aviza ..... B26B 21/4018 30/81
2007/0089297 A1 * 4/2007 Houbolt ..... B26B 21/22 30/34.2
2009/0188112 A1 * 7/2009 Prochaska ..... B26B 21/222 30/34.05
2009/0255124 A1 * 10/2009 Hasbani ..... B26B 21/225 30/50
2010/0299928 A1 * 12/2010 Clarke ..... B26B 21/4018 30/34.1
2011/0023305 A1 * 2/2011 Whelan ..... B26B 21/227 30/34.1
2011/0146079 A1 * 6/2011 Clarke ..... B26B 21/222 30/34.05
2011/0203113 A1 * 8/2011 Wang ..... B26B 21/4025 30/84
2012/0159787 A1 * 6/2012 Luxton ..... B26B 21/225 30/50
2012/0317818 A1 * 12/2012 Oglesby ..... B26B 21/4018 30/77
2014/0000114 A1 * 1/2014 Wester ..... B26B 21/4012 30/32
2014/0331500 A1 * 11/2014 Ren ..... B26B 21/34 30/41
2015/0082638 A1 * 3/2015 Georgakis ..... B26B 21/222 30/77
2015/0151443 A1 * 6/2015 Worrick, III ..... B26B 21/222 30/41
2016/0207210 A1 * 7/2016 Ren ..... B26B 21/4012
2016/0338928 A1 * 11/2016 Haught ..... B26B 21/443
2016/0354940 A1 * 12/2016 Bozikis ..... B26B 21/227
2017/0217033 A1 * 8/2017 Tucker ..... B26B 21/4031
2017/0282385 A1 * 10/2017 Bozikis ..... B26B 21/4043
2018/0029243 A1 * 2/2018 Bozikis ..... B26B 21/4031

FOREIGN PATENT DOCUMENTS

WO WO 2012006793 A1 * 1/2012 ..... B26B 21/34
WO WO 2017020158 A1 * 2/2017 ..... B26B 19/40

* cited by examiner

RAZOR HEAD HAVING A TRIMMING UNIT

RELATED APPLICATIONS

This application claims the benefit of priority to Chinese Patent Application No. 201510975675.2 filed in Dec. 22, 2015, which is hereby incorporated by reference in its entirety.

FIELD OF THE INVENTION

The present invention relates to a razor apparatus and, more particularly to a razor head having trimming unit being capable of simplifying technology and reducing manufacturing cost.

BACKGROUND OF THE INVENTION

With improvement of the economy and the society, abounding consumables are offered to people to satisfy people's demand, thereby improving people's standard or living. While razors are one of these consumables.

Currently, the razors have two types including electric razors and manual razors. Regarding the manual razors, as it has advantages of clean shave and no power source, so, takes up a large percentage of the market share.

Regarding the manual razors having trimming unit, the razor head thereof includes a framework, at least one razor blade, a trimming unit, a guide roller, a lubricating strip and so on. Wherein, the framework includes a front part, a rear part, and two side parts connecting the front part and the rear part. The razor blade is located between the front part and the rear part and assembled in the side parts. The guide roller is assembled on the front part, and the lubricating strip is embedded in the rear part. Further, the trimming unit is also assembled on the rear part, the trimming unit and the lubricating strip assembled are separated by one portion of the rear part, and the lubricating strip is disposed between the razor blade and the trimming unit, so that the rear part is configured to provide two structures for fixing the lubricating strip and the trimming unit respectively.

Since the rear part is configured to provide two separate structures for fixing the lubricating strip and the trimming unit respectively, so the manufacturing technology, the manufacturing materials and the manufacturing costs are increased.

Thus, there is a need for providing a razor head having trimming unit being capable of simplifying technology and reducing manufacturing cost to overcome the above-mentioned drawbacks.

SUMMARY OF THE INVENTION

One objective of the present invention is to provide a razor head having trimming unit being capable of simplifying technology and reducing manufacturing cost.

To achieve the above-mentioned objective, a razor head having trimming unit includes a framework, at least one razor blade, a trimming unit, and a lubricating strip, the framework includes a front part, a rear part and two side parts, the front part and the rear part are arranged along a lengthwise direction of the framework and spaced from each other side by side, the two side parts connects the front part to the rear part, the at least one razor blade is located between the front part and the rear part and arranged along the lengthwise direction of the framework, the at least one razor blade is configured on the two side parts, a cutting edge of the at least one razor blade faces toward the front part, the trimming unit is arranged along the lengthwise direction of the framework and configured on the two side parts, the trimming unit and the rear part are configured side by side and define a receiving groove together, the receiving groove is extended along the lengthwise direction of the framework, a side wall of the rear part for defining the receiving groove has a first contact portion extended into the receiving groove, a side wall of the trimming unit for defining the receiving groove has a second contact portion extended into the receiving groove, the second contact portion corresponds to the first contact portion along a direction perpendicular to the lengthwise direction of the framework, the lubricating strip is arranged along the lengthwise direction of the framework and inserted into the receiving groove, and the first contact portion and the second contact portion clamp the lubricating strip together.

Preferably, the number of the first contact portion and the second contact portion is equal and more than one, and the first contact portion and the second contact portion are aligned one by one along the direction perpendicular to the lengthwise direction of the framework and respectively arranged in a row along the lengthwise direction of the framework.

Preferably, a top end of the first contact portion has a guide surface inclined from up to down and toward the second contact portion, and the guide surface guides the lubricating strip into a space between the first contact portion and the second contact portion.

Preferably, the second contact portion comprises a base and a tapered portion, the tapered portion is extended from the base and inclined from up to down and toward the first contact portion, and the tapered portion is inserted into the lubricating strip in the receiving groove.

Preferably, the framework further comprises a intermediate part connected between the front part and the rear part, the intermediate part is located at a side of the framework away from the cutting edge, an arc-shaped projection adapted to be matched with a handle is extended from the intermediate part along a direction away from the cutting edge, the arc-shaped projection is arranged along a lengthwise direction of the two side parts, an arc slot is opened in the arc-shaped projection, the handle is slid in the arc slot so that the framework pivots relative to the handle, a center line of the arc slot is arranged along the lengthwise direction of the framework, and the center line is close to the cutting edge.

Preferably, the front part, the rear part and the two side parts together define a receiving cavity for receiving the at least one razor blade, at least one resilient leg is extended from each of the two side parts to the receiving cavity, the at least one razor blade is moved close to the at least one resilient leg along a first direction and then installed on the at least one resilient leg, and the at least one resilient leg presses against the at least one razor blade along a direction opposite to the first direction.

Preferably, the rear part comprises a separating plate for defining the receiving cavity and arranged along the lengthwise direction of the framework, the trimming unit comprises a supporting plate and a trimming blade connected to the supporting plate, the supporting plate is in a "7" shape, an upper end of the supporting plate is located at a side of the framework where the cutting edge is located, the trimming blade is configured on a lower end of the supporting plate, two sides of the supporting plate and the trimming blade is inserted into the two side parts along the first direction, the two side parts cover the two sides of the trimming blade and the supporting plate, the second contact portion is located on the supporting plate, and the first contact portion is located on the separating plate.

Preferably, a through hole communicated with the receiving cavity is opened in the rear part, the through hole is arranged along the lengthwise direction of the framework, the rear part further comprises a connecting plate, an end of the connecting plate is connected to an end of the separating plate away from the cutting edge, the other end of the connecting plate is extended to the supporting plate, and a bearing portion is extended from the upper end of the supporting plate to the separating plate and across the receiving groove along the direction perpendicular to the lengthwise direction of the framework.

Preferably, two through slots are opened in each of the two side parts, each of the two side parts comprises a clamping piece configured thereon, the clamping piece is in an inverted "U" shape and comprises a pressing section and two inserting sections, the pressing section is arranged along the direction perpendicular to the lengthwise direction of the framework, the two inserting sections are respectively bent downward from two ends of the pressing section and inserted into the two through slots along the first direction, a separating groove is opened in each of the two inserting sections and passes through a lower end of the inserting section along the first direction so as to form a splay engaging portion, the splay engaging portion tenses the pressing section along the first direction, the splay engaging portion is splayed to prevent the two inserting sections from being pulled out from the two through slots along a direction opposite to the first direction, the pressing section contacts with and presses against the at least one razor blade, and the at least one razor blade is clamped between the pressing section and the two side parts.

Preferably, the splay engaging portion comprises a first splay engaging portion and a second splay engaging portion, the first splay engaging portion and the second splay engaging portion are separated from each other by a tool so as to press against an inner wall of the two through slots.

In comparison with the prior art, since the trimming unit is arranged along the lengthwise direction of the framework and configured on the two side parts, the trimming unit and the rear part define a receiving groove together extended along the lengthwise direction of the framework, a side wall of the rear part for defining the receiving groove has a first contact portion extended into the receiving groove, a side wall of the trimming unit for defining the receiving groove has a second contact portion extended into the receiving groove, the second contact portion corresponds to the first contact portion along a direction perpendicular to the lengthwise direction of the framework, so when the lubricating strip is arranged along the lengthwise direction of the framework and inserted into the receiving groove, the first contact portion and the second contact portion clamp the lubricating strip together, that is to say, the lubricating strip is fixed by the second contact portion on the trimming unit and the first contact portion on the rear part, the trimming unit not only has a trimming function, but also has a function of fixing the lubricating strip. Meanwhile, as for a conventional razor head, because the lubricating strip and the trimming unit need to be assembled in the rear part, so the rear part needs to provide two separate structures for fixing the lubricating strip and the trimming unit respectively. While when the trimming unit of the present invention is assembled in the side part, a receiving groove for receiving the lubricating strip is formed by the trimming unit and the rear part, thereby simplifying technology and reducing manufacturing cost. More importantly, as the second contact portion corresponds to the first contact portion along a direction perpendicular to the lengthwise direction of the framework, so when the first contact portion and the second contact portion clamp the lubricating strip together, the middle of the trimming strip can be effectively prevented from deformation, thereby improving the reliability of the trimming unit.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings. By all appearances, the embodiments to be described just are a part of embodiments of the present invention, not the all. Based on the embodiment of the present invention, all other embodiments obtained by the person ordinarily skilled in the art without any creative work pertain to the protection scope of the present invention.

Figure 1:
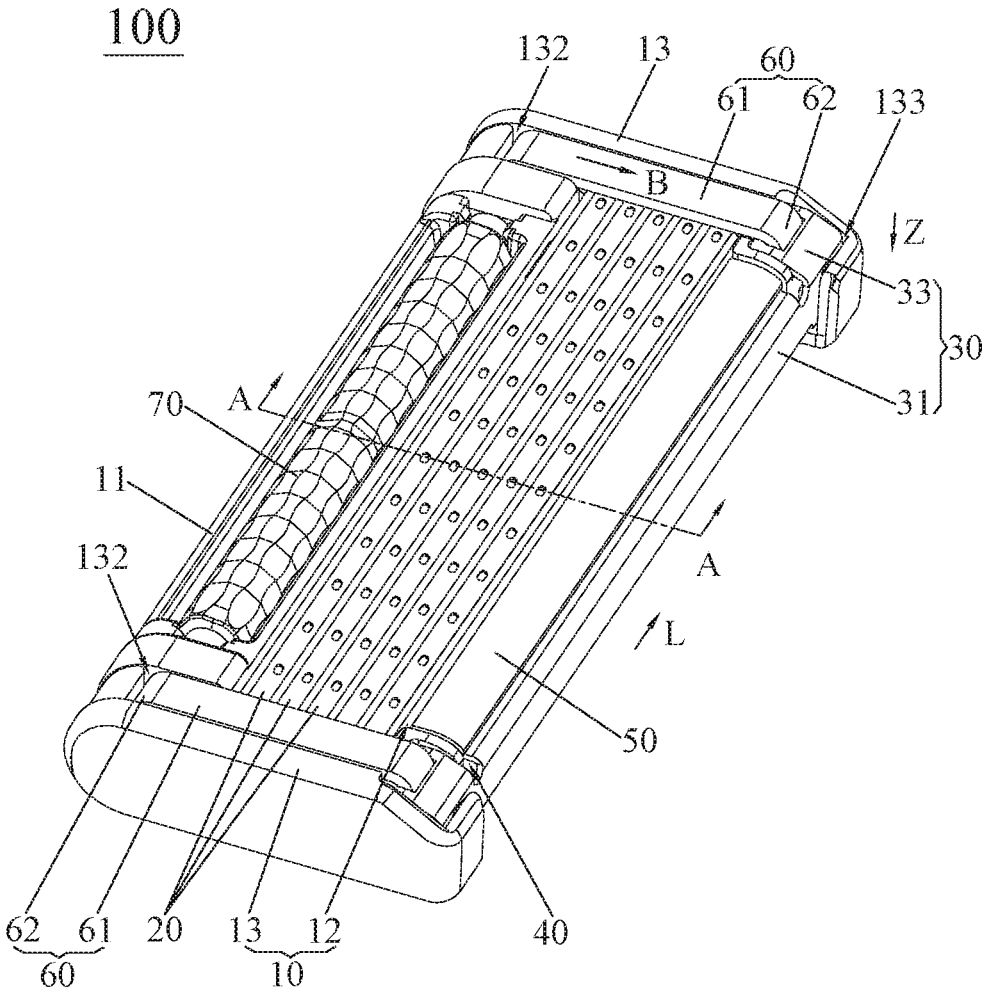
FIG. 1 is a perspective view of a razor head of the present invention.
Figure 2:
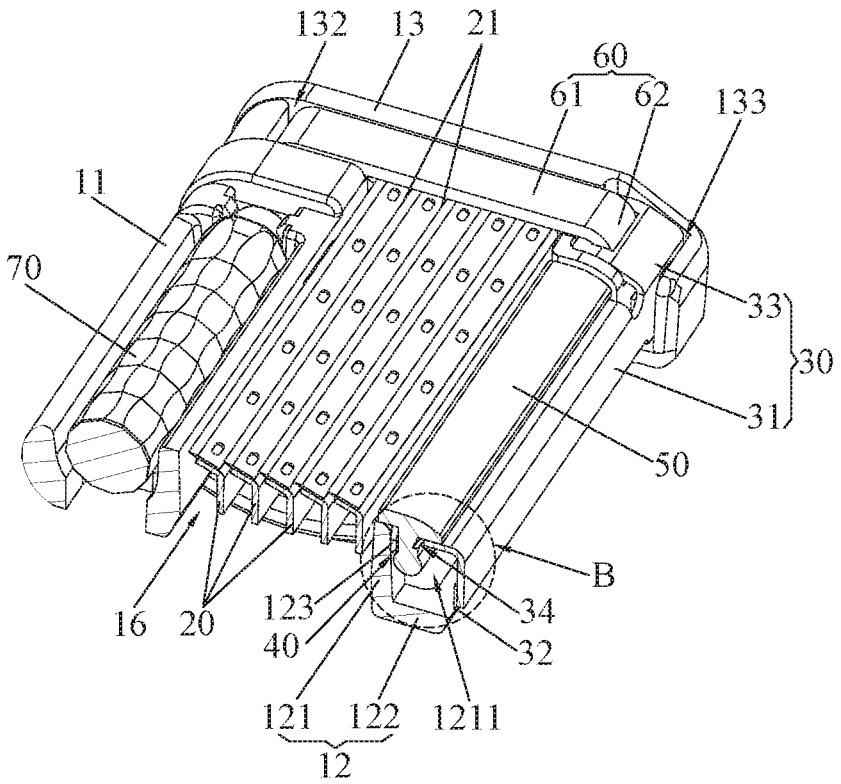
FIG. 2 is a cross-sectional view of the razor head along the A-A line in FIG. 1.

Referring to FIGS. 1 and 2, a razor head 100 of the present invention includes a framework 10, at least one at least one razor blade 20, a trimming unit 30, and a lubricating strip 50. The trimming unit 30 is separate, that is to say, the trimming unit 30 is separated from the at least one razor blade 20 while not directly connected to the at least one razor blade 20, so that the trimming unit 30 and the at least one razor blade 20 are individually assembled in the framework 10.

Figure 7:
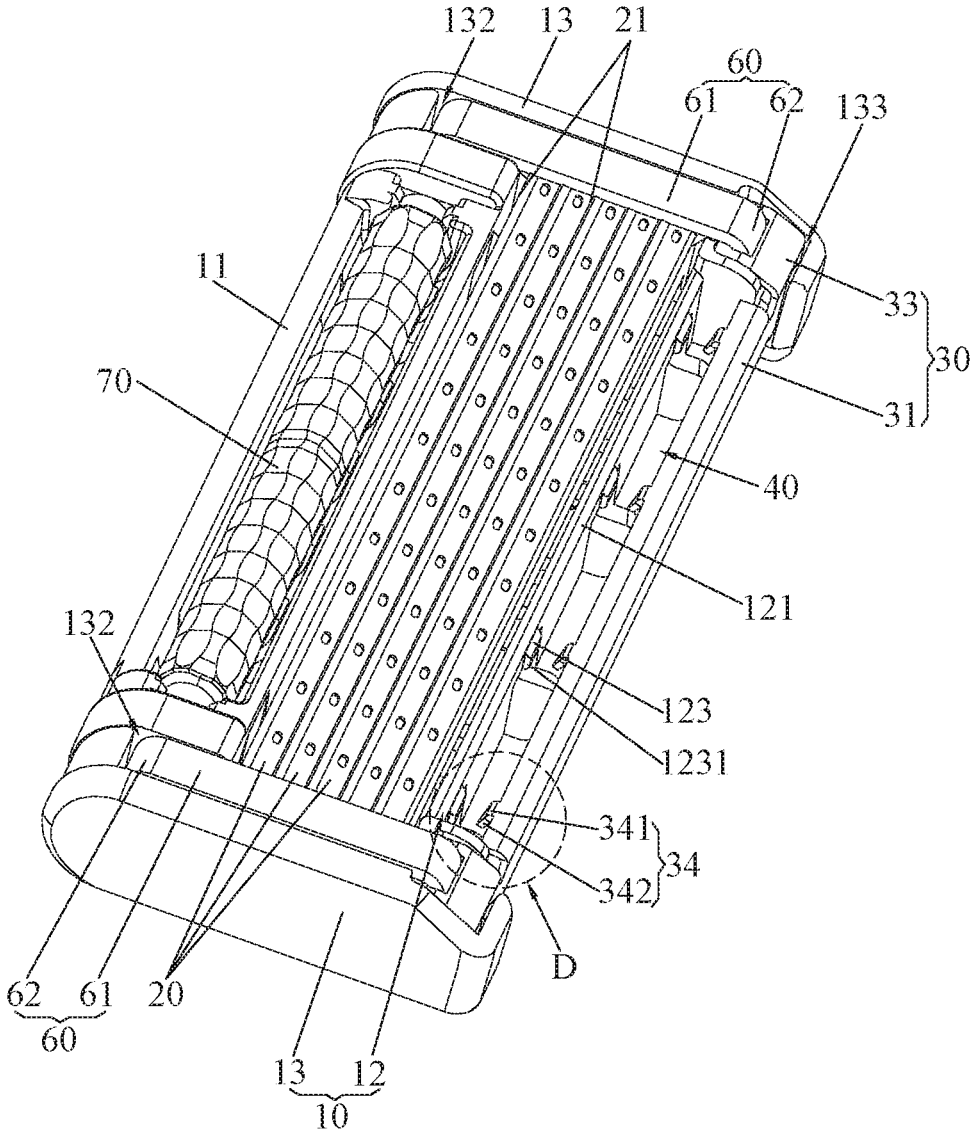
FIG. 7 is a perspective view of the razor head in FIG. 1 without a lubricating strip.
Figure 8:
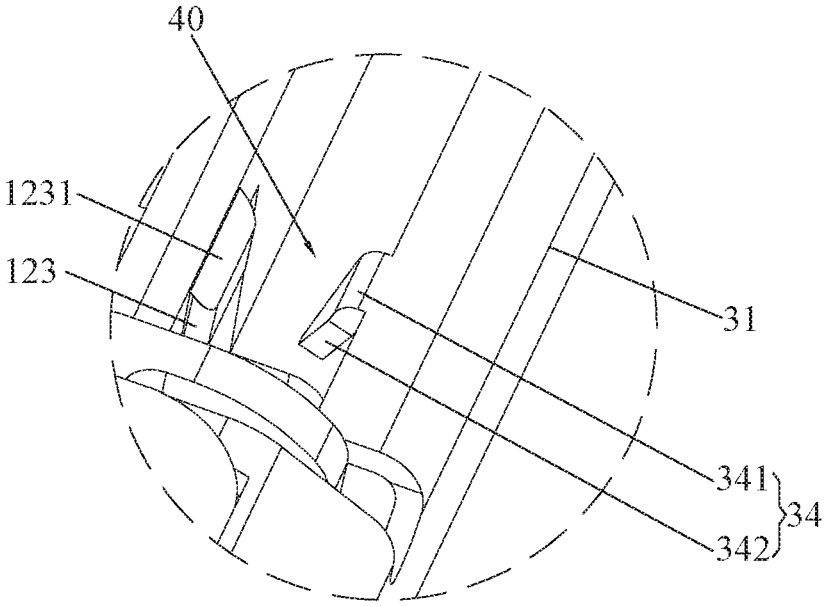
FIG. 8 is an enlarge view of section D in FIG. 7.
Figure 9:
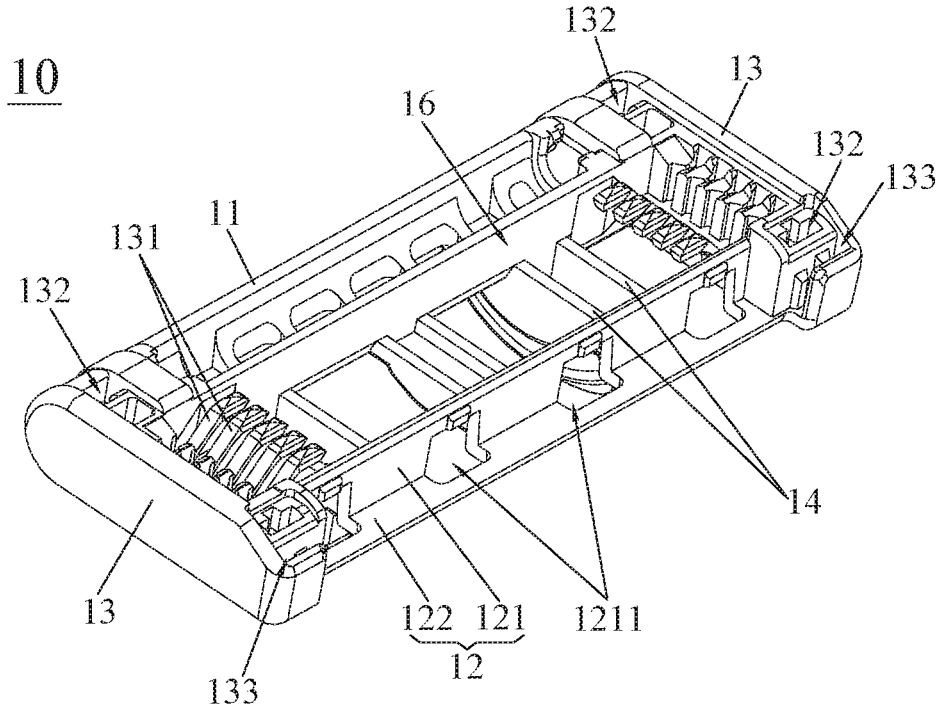
FIG. 9 is a perspective view of a framework of the razor head of the present invention.

As shown in FIGS. 7 and 9, the framework 10 includes a front part 11, a rear part 12 and two side parts 13, the front part 11 and the rear part 12 are arranged along a lengthwise direction of the framework 10 that is the direction of an arrow L in FIG. 1. The front part 11 and the rear part 12 are spaced from each other side by side, that is, the front part 11 and the rear part 12 are spaced from each other along a widthwise direction of the framework 10 that is the direction of an arrow B in FIG. 1, so that a space for installing the at least one razor blade 20 is formed. The two side parts 13 connect the front part 11 to the rear part 12 to form a frame-like structure in order to simplify the structure of the framework 10. Preferably, as shown in FIGS. 7 and 9, the front part 11 and the rear part 12 are parallel to each other, the two side parts 13 are parallel to each other, the front part 11 and the rear part 12 are located between the two side parts 13, the front part 11, one of the two side parts 13, the rear part 12 and the other one of the two side parts 13 are connected end to end so as to assemble the trimming unit 30 and the lubricating strip 50.

Figure 10:
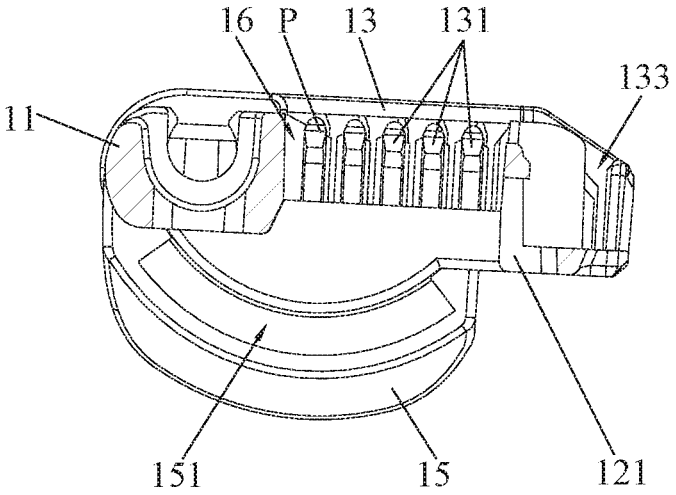
FIG. 10 is a cross-sectional view of the framework in the FIG. 9.

As shown in FIGS. 1 to 4, the at least one razor blade 20 is located between the front part 11 and the rear part 12 and arranged along the lengthwise direction L of the framework 10, the at least one razor blade 20 is configured on the two side parts 13, a cutting edge 21 of the at least one razor blade 20 faces toward the front part 11 to meet the requirements of shaving. Specifically, the front part 11, the rear part 12 and the two side parts 13 together define a receiving cavity 16 for receiving the at least one razor blade 20, at least one resilient leg 131 is extended from each of the two side parts 13 to the receiving cavity 16, as shown in FIGS. 9~10, preferably, the number of the at least one resilient leg 131 is same with that of the at least one razor blade 20, so that each of the at least one razor blade 20 is supported by one resilient leg 131, in the present embodiment, the number of the razor blade 20 is five, of course, in other embodiments, the number of razor blade 20 may be one, two, three or four, etc., it is not so limited. When the razor blade 20 is moved close to the resilient leg 131 along a first direction and then installed on the resilient leg 131, the resilient leg 131 presses against the razor blade 20 along a direction opposite to the first direction to prevent the razor blade 20 from further moving in the first direction. Wherein, a guide roller 70 is configured in the front part 11 to improve shaving effect, the guide roller 70 is arranged in the lengthwise direction L of the framework 10 and preferably parallel to the lubricating strip 50. The first direction is the direction of the arrow Z in FIG. 1.

Figure 3:
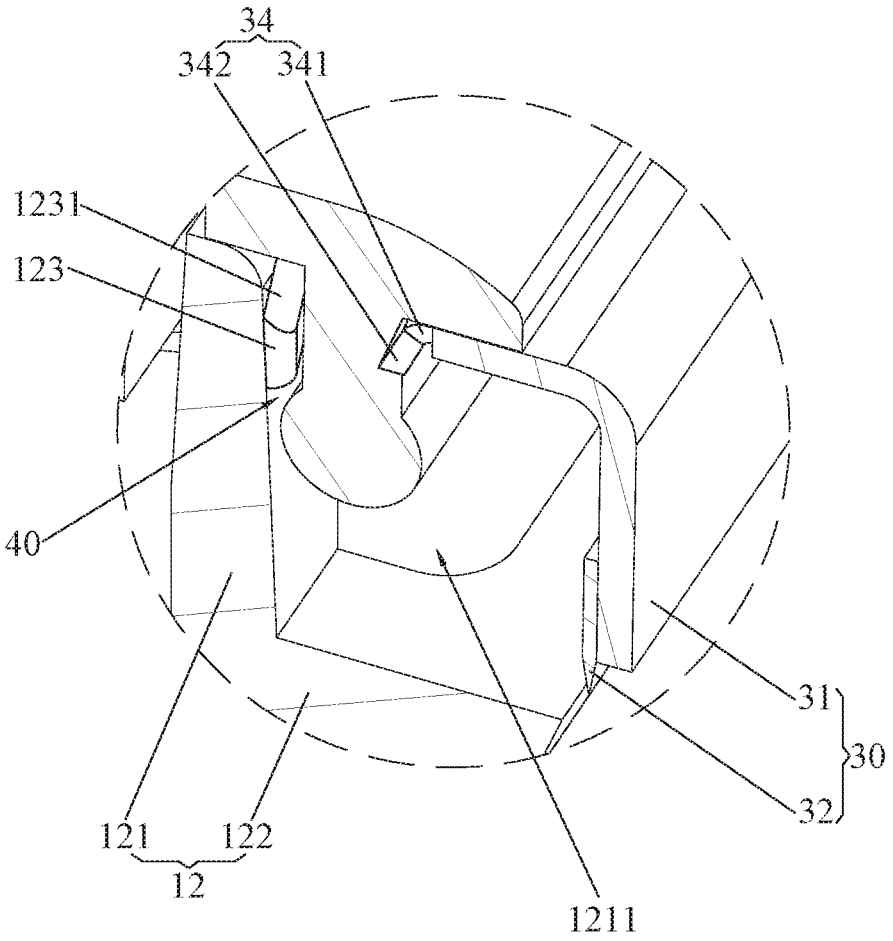
FIG. 3 is an enlarge view of section B in FIG. 2.
Figure 4:
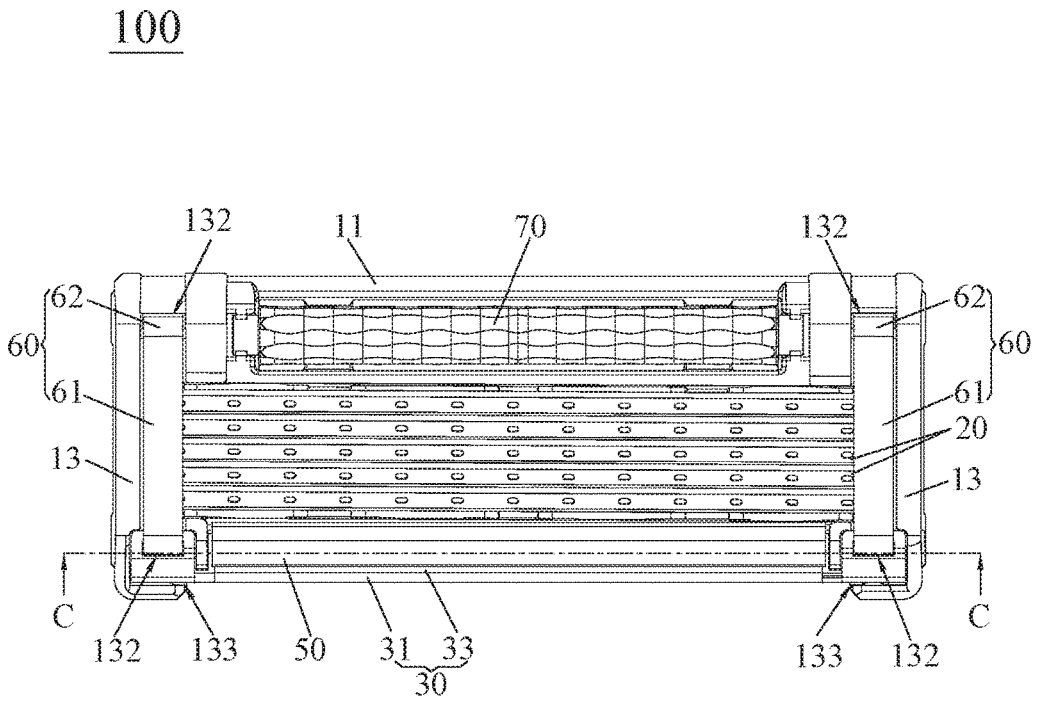
FIG. 4 is a plan view of the razor head shown in FIG. 1.

As shown in FIGS. 1~4, and 7~8, the trimming unit 30 is arranged along the lengthwise direction L of the framework 10 and configured on the two side parts 13, the trimming unit 30 and the rear part 12 are configured side by side and define a receiving groove 40 together, the receiving groove 40 is extended along the lengthwise direction L of the framework 10, a side wall of the rear part 12 used for defining the receiving groove 40 has a first contact portion 123 extended into the receiving groove 40, a side wall of the trimming unit 30 used for defining the receiving groove 40 has a second contact portion 34 extended into the receiving groove 40, the second contact portion 34 corresponds to the first contact portion 123 along the widthwise direction B of the framework 10. The lubricating strip 50 is arranged along the lengthwise direction L of the framework 10 and inserted into the receiving groove 40, and the first contact portion 123 and the second contact portion 34 clamp the lubricating strip 50 together. The number of the first contact portion 123 is equal to the number of the second contact portion 34, and the number of the first contact portion 123 is more than one, and the first contact portion 123 and the second contact portion 34 are aligned one by one along the widthwise direction B of the framework 10 and respectively arranged in a row along the lengthwise direction L of the framework 10 to further improve the clamping effect of the lubricating strip 50. Preferably, a top end of the first contact portion 123 has a guide surface 1231 inclined from up to down and toward the second contact portion 34, and the guide surface 1231 guides the lubricating strip 50 into a space between the first contact portion 123 and the second contact portion 34, so that the lubricating strip 50 can be squeezed into the receiving groove 40 easily and quickly. The second contact portion 34 includes a base 341 and a tapered portion 342, the tapered portion 342 is extended from the base 341 and inclined from up to down and toward the first contact portion 123, and the tapered portion 342 is inserted into the lubricating strip 50 in the receiving groove 40 (as shown in FIG. 3), which can effectively prevent the trimming unit 30 from deforming. Concretely, two sides of the trimming unit 30 are supported by the two side parts 13, while the middle section of the trimming unit 30 is in a suspended state, so the trimming unit 30 may be pressed to be deformed outwardly when the lubricating strip 50 is squeezed in the space in the first contact portion 123 and the second contact portion 34, while the tapered portion 342 of the second contact portion 34 is inserted into the flexible lubricating strip 50, which effectively lessens the pushing force to the trimming unit 30 by the lubricating strip 50, therefore, on the one hand, the lubricating strip 50 can be reliably clamped, on the other hand, the trimming unit 30 can be effectively prevented from deforming. As the tapered portion 342 is inclined from up to down and toward the first contact portion 123, so the lubricating strip 50 can be squeezed into the space between the first contact portion 123 and the second contact portion 34 easily and quickly, and the tapered portion 342 is in a shape of a barb, which can prevent the lubricating strip 50 between the first contact portion 123 and the second contact portion 34 from falling off.

The cross-section of the lubricating strip 50 along the widthwise direction B of the framework 10 is in a "T" shape, when a lower end of the lubricating strip 50 is inserted in the receiving groove 40, a lower surface of an upper end of the lubricating strip 50 is contacted with and supported by the rear part 12 and trimming unit 30, which improves the reliability of the lubricating strip 50. More specifically, as shown in FIG. 2 and FIG. 9, the rear part 12 includes a separating plate 121 used for defining the receiving cavity 16 and arranged along the lengthwise direction L, of the framework 10, the trimming unit 30 includes a supporting plate 31 and a trimming blade 32 connected to the supporting plate 31, the supporting plate 31 is in a "7" shape, an upper end of the supporting plate 31 is located at a side of the framework 10 where the cutting edge 21 is located, the trimming blade 32 is configured on a lower end of the supporting plate 31, so that the razor blade 20 would not interfere the trimming unit 30 during shaving. Preferably, the trimming blade 32 overlaps the supporting plate 31 partially. Two sides of the supporting plate 31 and the trimming blade 32 is inserted into the two side parts 13 along the first direction Z, the two side parts 13 cover the two sides of the trimming blade 32 and the supporting plate 31, which prevents a cutting edge of the two sides of the trimming blade 32 from hurting user. An inserting groove 133 is opened in each of the two side parts 13 along the first direction Z to allow the two sides of the supporting plate 31 and the trimming blade 32 to be inserted therein, so that the supporting plate 31 and the trimming blade 32 can be assembled in the two side parts 13 quickly.

As shown in FIG. 2, the supporting plate 31 and the separating plate 121 are arranged side by side, and the receiving groove 40 is defined by the supporting plate 31 and the separating plate 121, the second contact portion 34 is located on the supporting plate 31, and the first contact portion 123 is located on the separating plate 121. Preferably, the supporting plate 31 and the separating plate 121 are parallel to each other, so that the width of the receiving groove 40 along the lengthwise direction L of the framework 10 is constant. In this embodiment, the supporting plate 31 is located at the rear of the separating plate 121 to reduce the volume of the rear part 12. Preferably, the rear part 12 further includes a connecting plate 122, an end of the connecting plate 122 is connected to an end of the separating plate 121 away from the cutting edge 21, in this embodiment, the connecting plate 122 and the separating plate 121 are formed integrally so as to form the rear part 12, and the cross-section of the connecting plate 122 and the separating plate 121 along the widthwise direction B of the framework 10 is in a "L" shape. The other end of the connecting plate 122 is extended to the supporting plate 31, and a bearing portion 33 is extended from the upper end of the supporting plate 31 to the separating plate 121 and across the receiving groove 40 along a direction opposite to the widthwise direction B of the framework 10. Preferably, the bearing portion 33 is bent and extended from the supporting plate 31 to the separating plate 121, the number of the bearing portion 33 is two, two bearing portions 33 are respectively extended from two sides of the upper end of the supporting plate 31 and bent to contact with the two side parts 13, and a clamping piece 60 (described below) passes through the bearing portion 33 and then fixes the trimming unit 30. The bearing portion 33 is located above the connecting plate 122. A through hole 1211 communicated with the receiving cavity 16 is opened in the rear part 12 to discharge the trimming waste quickly, the through hole 1211 is arranged along the lengthwise direction L of the framework 10. The trimming unit 30 of the supporting plate 31 is made of rigid material, Preferably is made of metal, but not limited thereto.

As shown in FIGS. 9 and 10, the framework 10 further includes a intermediate part 14 connected between the front part 11 and the rear part 12, the intermediate part 14 is located at a side of the framework 10 away from the cutting edge 21. An arc-shaped projection 15 adapted to be matched with a handle is extended from the intermediate part 14 along a direction away from the cutting edge 21, the arc-shaped projection 15 is arranged along a lengthwise direction of the two side parts 13. Preferably, the two side parts 13 and the arc-shaped projection 15 are arranged side by side, an arc slot 151 is opened in the arc-shaped projection 15, the handle is slid in the arc slot 151 so that the framework 10 pivots relative to the handle, a center line of the arc slot 151 is arranged along the lengthwise direction L of the framework 10, the center line is a line passing through the point P in FIG. 10 and perpendicular to the paper surface of FIG. 10, the center line is close to the cutting edge 21, namely, the framework 10 pivots relative to the handle around the center line to improve the shaving effects.

Referring to FIGS. 1~7, two through slots 132 are opened in each of the two side parts 13, the inserting groove 133 is located at the rear of the two through slots 132. Each of the two side parts 13 has a clamping piece 60 configured thereon. The clamping piece 60 is in an inverted "U" shape and includes a pressing section 61 and two inserting sections 62, the pressing section 61 is arranged along the widthwise direction B of the framework 10 and on the razor blade 20, the two inserting sections 62 are respectively bent downward from two ends of the pressing section 61 and inserted into the two through slots 132 along the first direction Z, a separating groove 621 is opened in each of the two inserting sections 62 and passes through a lower end of the inserting section 62 along the first direction Z so as to form a splay engaging portion 63, the splay engaging portion 63 tenses the pressing section 61 along the first direction Z, the splay engaging portion 63 is splayed to prevent the two inserting sections 62 from being pulled out from the two through slots 132 along a direction opposite to the first direction Z, the pressing section 61 contacts with and presses against the razor blade 20, and the razor blade 20 is clamped between the pressing section 61 and the two side parts 13. The splay engaging portion 63 in the through slot 132 is splayed toward an inner wall of the through slot 132 to assist the pressing section 61 to clamp the razor blade 20, thereby simplifying the installing of the clamping piece 60, shortening the length of the clamping piece 60, reducing the cost of the clamping piece 60.

Figure 5:
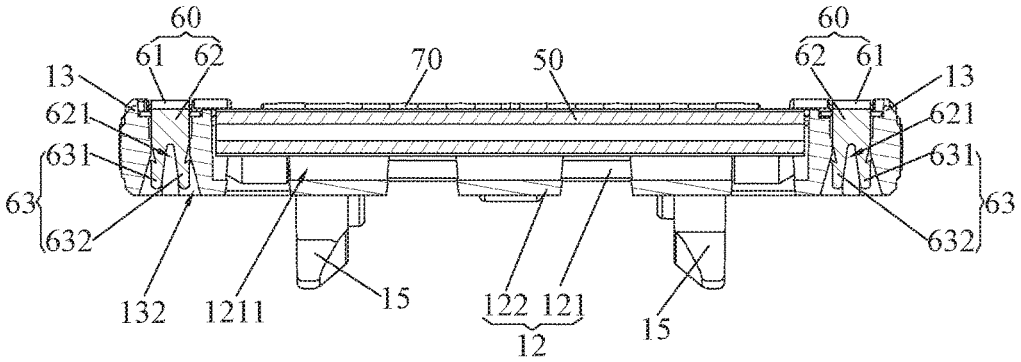
FIG. 5 is a cross-sectional view along the line C-C in FIG. 4.

Specifically, as shown in FIG. 5, after the inserting section 62 has been inserted into the through slot 132 along the first direction Z, a tool is pressingly inserted into the separating groove 621 along a direction opposite to the first direction Z, and then the splay engaging portion 63 is splayed by the tool and contacted with the inner wall of the through slot 132, and then the clamping piece 60 is installed on the framework 10. Concretely, before the inserting section 62 is inserted into the through slot 132, the splay engaging portion 63 has not been splayed apart and has no plastic deformation, and the size of the splay engaging portion 63 is smaller than that of an opening of the through slot 132. After the inserting section 62 has been inserted into the through slot 132, the splay engaging portion 63 is located in the through slot 132, then pressingly inserting the tool into the separating groove 621 along a direction opposite to the first direction Z, the splay engaging portion 63 is splayed by the tool to produce plastic deformation, namely non-elastic deformation, and then the splay engaging portion 63 is contacted with the inner wall of the through slot 132 to prevent the two inserting sections 62 from being pulled out from the two through slots 132 along a direction opposite to the first direction Z.

Figure 6:
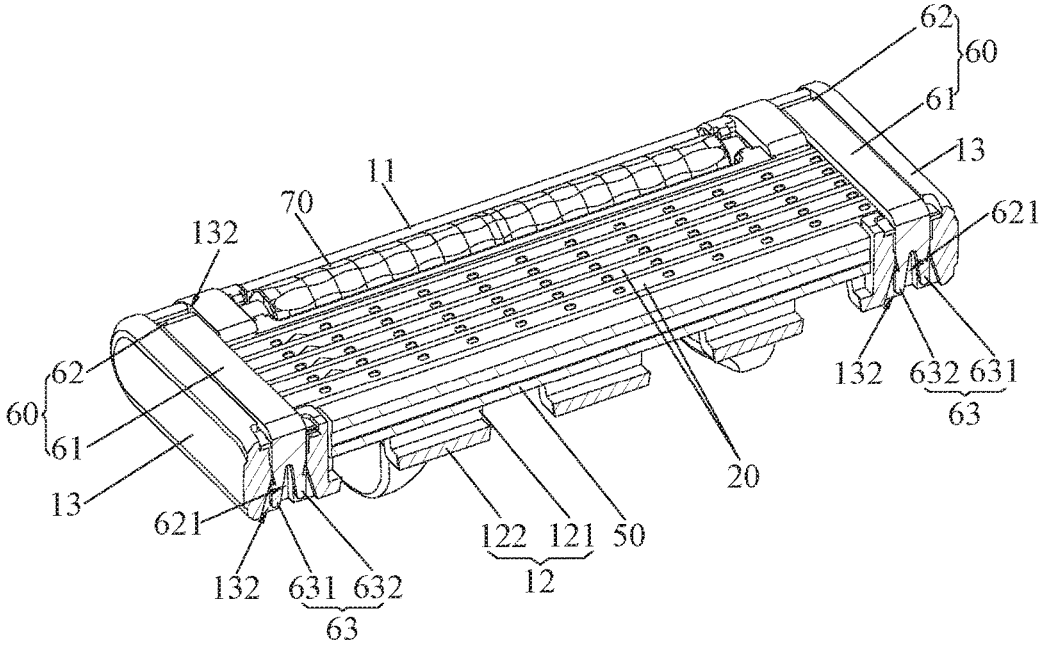
FIG. 6 is another cross-sectional view along the line C-C in FIG. 4.
Figure 11:
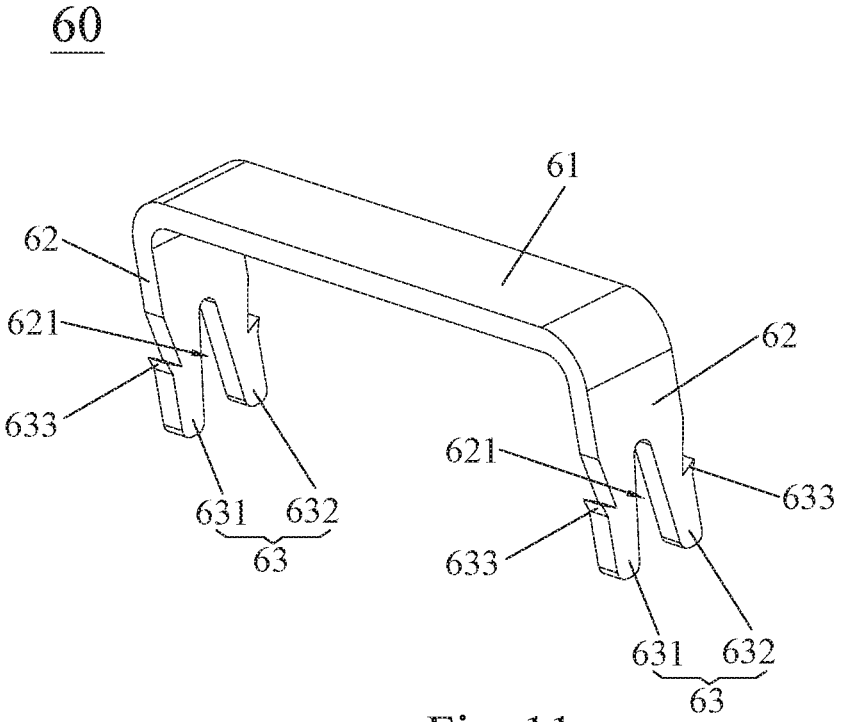
FIG. 11 is a perspective view of a clamping piece of the razor head of the present invention.

Concretely, as shown in FIGS. 6 and 11, the splay engaging portion 63 includes a first splay engaging portion 631 and a second splay engaging portion 632, the first splay engaging portion 631 and the second splay engaging portion 632 are separated from each other by the tool so as to contact with and press against the inner wall of the two through slots 132. As shown in FIG. 11, each of the two inserting sections 62 has one separating groove 621, two inserting sections 62 of the clamping piece 60 are respectively inserted in one through slot 132 close to the front part 11 and the other one through slot 132 close to the rear part 12 and then fixed in the two through slots 132, so as to assemble the clamping piece 60 on the framework 10 quickly, two barbs 633 are formed respectively on the first splay engaging portion 631 and the second splay engaging portion 632, when the first splay engaging portion 631 and the second splay engaging portion 632 has been splayed by the tool, the two barbs 633 contact with the inner wall of the through slot 132 and prevent the inserting section 62 from being pulled out. As shown in FIGS. 5 and 6, the cross-section of the through slot 132 along the first direction Z is in a splayed shape, specifically, one end of the through slot 132 that is far away from the pressing section 61 forms an enlarged slot, and the first splay engaging portion 631 and the second splay engaging portion 632 is splayed in the enlarged slot. Wherein, the clamping piece 60 passes through the trimming unit 30 along the first direction Z and then enters into the two through slots 132, so as to clamp the trimming unit 30 along with the razor blade 20, the trimming unit 30 is clamped by the pressing section 61 and the two side parts 13 together. Concretely, the inserting section 62 firstly passes through the supporting plate 31 of the trimming unit 30 and then enters into the through slot 132, preferably, as shown in FIG. 2, the inserting section 62 firstly passes through the bearing portion 33 extended from the supporting plate 31 of the trimming unit 30 and then enters into the through slot 132.

In comparison with the prior art, since the trimming unit 30 is arranged along the lengthwise direction L of the framework 10 and configured on the two side parts 13, the trimming unit 30 and the rear part 12 define a receiving groove 40 together extended along the lengthwise direction L of the framework 10, a side wall of the rear part 12 used for defining the receiving groove 40 has a first contact portion 123 extended into the receiving groove 40, a side wall of the trimming unit 30 used for defining the receiving groove 40 has a second contact portion 34 extended into the receiving groove 40, the second contact portion 34 corresponds to the first contact portion 123 along a widthwise direction B of the framework 10. So when the lubricating strip 50 is arranged along the lengthwise direction L of the framework 10 and inserted into the receiving groove 40, the first contact portion 123 and the second contact portion 34 clamp the lubricating strip 50 together, that is to say, the lubricating strip 50 is fixed by the second contact portion 34 on the trimming unit 30 and the first contact portion 123 on the rear part 12, the trimming unit 30 not only has a trimming function, but also has a function of fixing the lubricating strip 50. Meanwhile, as for a conventional razor head, because the lubricating strip and the trimming unit need to be assembled in the rear part, so the rear part needs to provide two separate structures for fixing the lubricating strip and the trimming unit respectively. While when the trimming unit 30 of the present invention is assembled in the two side parts 13, a receiving groove 40 for receiving the lubricating strip 50 is formed by the trimming unit 30 and the rear part 12, thereby simplifying technology and reducing manufacturing cost. More importantly, as the second contact portion 34 corresponds to the first contact portion 123 along the widthwise direction B of the framework 10, so when the first contact portion 123 and the second contact portion 34 clamp the lubricating strip 50 together, the middle of the trimming strip 50 can be effectively prevented from deformation, thereby improving the reliability of the trimming unit 50.

As shown in FIG. 5, the inserting section 62 is inserted in the through slot 132, that is to say, the inserting section 62 is received in the through slot 132 without extending out, which can avoid hurting user. Preferably, the clamping piece 60 is made of aluminum, of course, other materials can also be applied in the present invention.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A razor head comprising:

a framework, the framework comprising a front part, a rear part and two side parts, the front part and the rear part being arranged along a lengthwise direction of the framework and spaced from each other side by side, the two side parts connecting the front part to the rear part;

at least one razor blade, the at least one razor blade being located between the front part and the rear part and arranged along the lengthwise direction of the framework, the at least one razor blade being configured on the two side parts, a cutting edge of the at least one razor blade facing toward the front part;

a trimming unit comprising a trimming blade, the trimming unit being arranged along the lengthwise direction of the framework and configured on the two side parts, the trimming unit and the rear part being configured side by side and defining a receiving groove together, the receiving groove being extended along the lengthwise direction of the framework, a side wall of the rear part for defining the receiving groove having at least one first contact portion extended into the receiving groove, a side wall of the trimming unit for defining the receiving groove having at least one second contact portion extended into the receiving groove, the at least one second contact portion corresponding to the at least one first contact portion along a direction perpendicular to the lengthwise direction of the framework; and a lubricating strip, the lubricating strip being arranged along the lengthwise direction of the framework and inserted into the receiving groove, the at least one first contact portion and the at least one second contact portion clamping the lubricating strip together.

2. The razor head according to claim 1, wherein the at least one first contact portion is a plurality of first contact portions, the at least one second contact portion is a plurality of second contact portions, and a number of the plurality of first contact portions is equal to a number of the plurality of second contact portions.

3. The razor head according to claim 1, wherein a head end of the first contact portion has a guide surface which is inclined toward the at least one second contact portion.

4. The razor head according to claim 1, wherein the at least one second contact portion comprises a base and a tapered portion, the tapered portion is extended from the base and inclined toward the at least one first contact portion, and the tapered portion is inserted into the lubricating strip in the receiving groove.

5. The razor head according to claim 1, wherein the framework further comprises an intermediate part connected between the front part and the rear part, the intermediate part is located at a side of the framework away from the cutting edge, an arc-shaped projection is extended from the intermediate part along a direction away from the cutting edge, the arc-shaped projection is arranged along a lengthwise direction of the two side parts, an arc slot is opened in the arc-shaped projection, a center line of the arc slot is arranged along the lengthwise direction of the framework, and the center line is close to the cutting edge.

6. The razor head according to claim 1, wherein the front part, the rear part and the two side parts together define a receiving cavity for receiving the at least one razor blade, at least one resilient leg is extended from each of the two side parts to the receiving cavity, the at least one razor blade is detachably connected to the at least one resilient leg, and the at least one resilient leg is biased against the at least one razor blade.

7. The razor head according to claim 6, wherein the rear part comprises a separating plate for defining the receiving cavity and arranged along the lengthwise direction of the framework, the trimming unit comprises a supporting plate and the trimming blade connected to the supporting plate, the supporting plate is in a "7" shape, a head end of the supporting plate is located at a side of the framework where the cutting edge is located, the trimming blade is configured on a tail end of the supporting plate, two sides of the supporting plate and the trimming blade located on the two side parts, the two side parts cover the two sides of the trimming blade and the supporting plate, the at least one second contact portion is located on the supporting plate, and the at least one first contact portion is located on the separating plate.

8. The razor head according to claim 7, wherein a through hole communicated with the receiving cavity is opened in the rear part, the through hole is arranged along the lengthwise direction of the framework, the rear part further comprises a connecting plate, an end of the connecting plate is connected to an end of the separating plate away from the cutting edge, the other end of the connecting plate is extended to the supporting plate, and a bearing portion is extended from the head end of the supporting plate to the separating plate and across the receiving groove along the direction perpendicular to the lengthwise direction of the framework.

9. The razor head according to claim 6, wherein each of the two side parts has two through slots, each of the two side parts comprises a clamping piece configured thereon, the clamping piece is in an inverted "U" shape and comprises a pressing section and two inserting sections, the pressing section is arranged along the direction perpendicular to the lengthwise direction of the framework, the two inserting sections are curved and engaging with the two through slots, each of the two inserting sections has a separating groove passing through a tail end of the inserting section, each of the two inserting sections has a splay engaging portion, the splay engaging portion tenses the pressing section, the pressing section contacts with and presses against the at least one razor blade, and the at least one razor blade is clamped between the pressing section and the two side parts.

10. The razor head according to claim 9, wherein the splay engaging portion comprises a first splay engaging portion and a second splay engaging portion, the first splay engaging portion and the second splay engaging portion engage with the through slot.

* * * * *